US006294132B1

(12) United States Patent
Tetsui

(10) Patent No.: US 6,294,132 B1
(45) Date of Patent: Sep. 25, 2001

(54) TIAL INTERMETALLIC COMPOUND-BASED ALLOY

(75) Inventor: Toshimitsu Tetsui, Nagasaki (JP)

(73) Assignee: Mitsubishi Heavy Industries Ltd., Tokyo (JP)

( * ) Notice: Subject to any disclaimer, the term of this patent is extended or adjusted under 35 U.S.C. 154(b) by 0 days.

(21) Appl. No.: 09/301,534

(22) Filed: Apr. 28, 1999

(51) Int. Cl.[7] ..... C22C 14/00

(52) U.S. Cl. ..... 420/418; 420/588; 420/421; 148/421

(58) Field of Search ..... 420/552, 421, 420/588, 418; 148/421

(56) References Cited

U.S. PATENT DOCUMENTS

| | | | | |
|---|---|---|---|---|
| 5,350,466 | * | 9/1994 | Larsen, Jr. et al. | 148/421 |
| 5,429,796 | * | 7/1995 | Larsen, Jr. | 420/590 |
| 5,431,754 | | 7/1995 | Fujiwara et al. | 148/669 |
| 5,653,828 | * | 8/1997 | Zhao et al. | 148/671 |

FOREIGN PATENT DOCUMENTS

| | | | |
|---|---|---|---|
| 06269927A | * | 2/1993 | (JP) . |
| 05320791 | | 12/1993 | (JP) . |
| 06346173 | | 12/1994 | (JP) . |
| 07197154 | | 8/1995 | (JP) . |
| 09143599 | | 6/1997 | (JP) . |
| 09176763 | | 7/1997 | (JP) . |
| 9630551 | * | 10/1996 | (WO) . |
| 9949090 | * | 3/1998 | (WO) . |

* cited by examiner

*Primary Examiner*—Roy King
*Assistant Examiner*—Nicole Coy
(74) *Attorney, Agent, or Firm*—Alston & Bird LLP

(57) ABSTRACT

This invention relates to a TiAl intermetallic compound-based alloy exhibiting excellent heat resistance, oxidation resistance and resonance resistance and having a cast structure composed of fine equiaxed grains. Specifically, it relates to a TiAl intermetallic compound-based alloy comprising of 45 to 48 atomic percent of Al, 5 to 9 atomic percent of Nb, 1 to 2 atomic percent of Cr, 0.2 to 0.5 atomic percent of Si, 0.3 to 2 atomic percent of Ni, 0.01 to 0.05 atomic percent of Y, and the balance being Ti and incidental impurities, the alloy exhibiting excellent heat resistance, oxidation resistance and resonance resistance and having a cast structure formed of fine equiaxed grains.

17 Claims, 1 Drawing Sheet

TIAL INTERMETALLIC COMPOUND-BASED ALLOY

BACKGROUND OF THE INVENTION

1. Field of the Invention

This invention relates to a TiAl intermetallic compound-based alloy which exhibits excellent heat resistance, oxidation resistance and resonance resistance, has a cast structure composed of fine equiaxed grains, and is hence suitable for use in the manufacture of rotating components such as the turbine wheels of small-sized superchargers used in passenger cars and trucks, and the turbine blades of large-sized superchargers for ships, jet engines and industrial gas turbines.

2. Description of the Related Art

As a result of a growing interest in environmental problems in recent years, it is desired to enhance the performance of superchargers used in means of conveyance such as passenger cars, trucks and ships, as well as the efficiency of jet engines, industrial gas turbines and the like. Among the various elements constituting the aforesaid products, an important one which governs their performance or efficiency is a turbine. In recent years, several requirements have been proposed for such turbines. They include, for example, an improvement in transient response characteristics, a rise in turbine inlet temperature, and an increase in rotational speed.

The only possible answer to these requirements is an improvement of the materials used for rotating components such as turbine wheels, turbine discs and turbine blades. In order to achieve a rise in turbine inlet temperature, and an increase in rotational speed, an improvement in high-temperature strength (including creep strength) is required, provided that the current Ni-base superalloys are used as starting materials.

However, it has become difficult to further improve high-temperature strength from a compositional point of view. In the present situation, therefore, the focus of investigation has recently shifted to special manufacturing processes involving, for example, conversion into a single crystal. Although such measures may be effectively employed for expensive products manufactured in small quantities, such as turbine blades of jet engines, it is difficult from the viewpoint of cost to employ such special manufacturing processes for mass-produced articles having a complicated shape, such as small-sized superchargers for passenger cars. Moreover, in the case of Ni-base superalloys, it is essentially impossible to achieve an improvement in transient response characteristics by modifying the materials, because the Ni-base superalloys have substantially the same specific gravity (about 8–9), irrespective of composition.

On the other hand, alloys consisting essentially of the intermetallic compound TiAl (hereinafter referred to as TiAl-base alloys) are attracting attention as new metallic materials in recent years. Since these alloys are characterized by light weight (i.e., a specific gravity of about 4) and excellent high-temperature strength, they are promising for meeting the aforesaid three requirements. That is, since their light weight gives a small moment of inertia, it is naturally possible to improve transient response characteristics.

As to the stress loaded on a rotating body, it is only needed to consider its specific strength (i.e., its strength divided by its specific gravity). Since the specific gravity of TiAl-base alloys is one-half of that of Ni-base superalloys, it may be simply said that, if the high-temperature strength of TiAl-base alloys is greater than one-half of that of Ni-base superalloys, a rise in turbine inlet temperature and an increase in rotational speed can be achieved.

As described above, TiAl-base alloys are promising for use as turbine components. However, when their practical use as actual products is taken into consideration, they need to be excellent not only in high-temperature strength, but also in general material characteristics such as fatigue strength, fracture toughness, oxidation resistance and room-temperature ductility. In addition, since the products to be made are rotating components having a complicated shape, the following two characteristics are required.

(1) They must have excellent resonance resistance.

Since a constant driving force acts upon rotating components during service, this may induce resonance. If resonance occurs, the resulting vibrations and noises exceed an allowable level and exert an adverse influence on the environment. In extreme cases, the component may suffer a fatigue failure. It would be difficult to prevent such dangerous resonance solely by design means. Moreover, since the pursuit of this object might produce undesirable effects such as an unduly increased size of the structure, it is a common concept to provide the material itself with the ability to damp vibrations. To this end, the material needs to have high damping power, i.e., great internal friction.

(2) They must have a cast structure formed of fine equiaxed grains.

In many cases, the shapes of the aforesaid rotating components have three-dimensional curved surfaces owing to the required aerodynamic characteristics. Moreover, since the aforesaid rotating components are mass-produced articles, they must be able to be produced in large quantities. Consequently, it is difficult to apply forging and machining processes to these rotating components, and they must be fabricated by precision casting.

In the case of cast articles, their structure is formed during casting, and cannot be easily modified by subsequent heat treatment or the like. Thus, it may be said that the structure is determined by the alloy composition.

If this cast structure is a columnar structure in which the central part of the material solidifies lastly, this is undesirable from the viewpoint of high-speed rotation and reliability because the concentration of impurities and the development of defects tend to occur in the central part which is subjected to the greatest load stress during rotation. Moreover, if the crystal grains of the cast structure are enlarged, the concentration of impurities tends to increase at grain boundaries. Furthermore, in such a case, TiAl-base alloys tend to suffer a transgranular fracture due to cleavage, and hence pose similar problems.

That is, it may be said that a structure in which the above-described problems scarcely arise, namely a structure formed of fine equiaxed grains, is desirable for cast articles for use as rotating components. The desired structure must be produced during casting because, unlike forged articles, cast articles cannot be post-treated by a thermo-mechanical treatment for making the structure finer by recrystallization. To this end, it is necessary to optimize the composition.

Since TiAl-base alloys are attracting attention as new metallic materials of the next generation, they are now being actively investigated all over the world. As a result, it has become possible to improve various properties such as room-temperature ductility and high-temperature strength, by adding suitable alloying elements or optimizing heat-treating conditions.

However, previous investigations on TiAl-base alloys have inclined toward improvements in basis characteristics of materials in general, and no consideration has been given to an improvement in material characteristics which are actually required for practical use on the basis of shape, service environment and the like.

As to the products with which the present invention is concerned, the previously described two requirements for cast rotary components having a complicated shape, i.e., (1) excellent resonance resistance and (2) a cast structure formed of fine equiaxed grains, have scarcely been examined thus far. In other words, it has not been intended in the prior art to improve all of the characteristics required for cast rotating components made of a TiAl-base alloy. Consequently, it may be said that, although TiAl-base alloys have been expected to contribute to an improvement in the performance or efficiency of small-sized superchargers for passenger cars and trucks, large-sized superchargers for ships, jets engines, industrial gas turbines, and the like, it has been difficult to use them for practical purposes in the industrial world.

In view of the above-described existing state of the art, an object of the present invention is to provide a TiAl intermetallic compound-based alloy which not only shows an improvement in general material characteristics such as oxidation resistance, room-temperature ductility and high-temperature strength, but also meets the requirements for its practical use as cast rotating components, i.e., excellent resonance resistance and a cast structure formed of fine equiaxed grains.

SUMMARY OF THE INVENTION

In a cast TiAl-base alloy which is aimed at in the present invention, a structure is formed during casting as described previously, and material characteristics are determined thereby. Accordingly, the composition of a material must be optimized in order to obtain desired characteristics. To this end, the present inventors examined the effects of various alloy components and have found, together with the previous results of examination, the fact that various alloying elements have the following effects.

Specifically, as shown in Japanese Patent Provisional Publication Nos. 320791/'93 and 346173/'94 and Japanese Patent Application No. 12056/'94, it has been found that the addition of a relatively large amount of Nb is effective in improving oxidation resistance which is a characteristic required for long-term use in a temperature range of 800° C. and above that is a high-temperature range for TiAl-base alloys. Moreover, as shown in Japanese Patent Application Nos. 296410/'95 and 338667/'95, it has also been found that the addition of Ni is effective in improving resonance resistance.

Furthermore, the present inventors have now found that the addition of appropriate amounts of Cr and Si is effective in achieving a well-balanced improvement in various material characteristics such as high-temperature creep strength and room-temperature ductility, and that the addition of a slight amount of Y is effective in obtaining a cast structure formed of fine equiaxed grains.

The present invention, which has been completed on the basis of the above-described various findings, relates to a TiAl intermetallic compound-based alloy consisting essentially of 45 to 48 atomic percent of Al, 5 to 9 atomic percent of Nb, 1 to 2 atomic percent of Cr, 0.2 to 0.5 atomic percent of Si, 0.3 to 2 atomic percent of Ni, 0.01 to 0.05 atomic percent of Y, and the balance being Ti and incidental impurities, the alloy exhibiting excellent heat resistance, oxidation resistance and resonance resistance and having a cast structure formed of fine equiaxed grains.

(Action) The action of various components in the alloy of the present invention, and the reasons for the restriction of their contents are described below.

(1) Al (aluminum): Al is a principal constituent element of this alloy. If its content is less than 45 atomic percent, the alloy will show a reduction in room-temperature ductility. On the other hand, if its content is greater than 48 atomic percent, the alloy will show a reduction in high-temperature strength. Accordingly, the content of Al should be in the range of 45 to 48 atomic percent and preferably 46 to 47 atomic percent.

(2) Nb (niobium): The main action of Nb is to improve oxidation resistance. Moreover, Nb also functions to improve high-temperature strength. If its content is less than 5 atomic percent, this will be insufficient from the viewpoint of oxidation resistance at about 800° C. or above, and its addition will produce no effect. On the other hand, even if its content is greater than 9 atomic percent, no significant improvement in oxidation resistance will be achieved as compared with its addition at lower contents. On the contrary, undesirable effects such as an increase in specific gravity and a reduction in room-temperature ductility will be produced. Accordingly, the content of Nb should be in the range of 5 to 9 atomic percent and preferably 6 to 8 atomic percent.

(3) Cr (chromium): Cr is an alloy component added for the purpose of improving room-temperature ductility. If its content is less than 1 atomic percent, its addition will produce no effect. On the other hand, if its content is greater than 2 atomic percent, the alloy will show a reduction in high-temperature strength. Accordingly, the content of Cr should be in the range of 1 to 2 atomic percent and preferably 1.2 to 1.6 atomic percent.

(4) Si (silicon): Si is an alloy component added for the purpose of improving high-temperature strength and, in particular, creep strength. If its content is less than 0.2 atomic percent, its addition will produce no effect. On the other hand, if its content is greater than 0.5 atomic percent, the alloy will show a reduction in room-temperature ductility. Accordingly, the content of Cr should be in the range of 0.2 to 0.5 atomic percent and preferably 0.3 to 0.4 atomic percent.

(5) Ni (nickel): Ni is an alloy component added for the purpose of increasing internal friction and improving resonance resistance. If its content is less than 0.3 atomic percent, its addition will produce no effect. On the other hand, if its content is greater than 2 atomic percent, no substantial difference in internal friction will be noted as compared with its addition in smaller amounts, but the alloy will show a reduction in room-temperature ductility owing to the formation of harmful phases such as Laves phase. Accordingly, the content of Ni should be in the range of 0.3 to 2 atomic percent and preferably 0.5 to 1.2 atomic percent.

(6) Y (yttrium): Y is an alloy component added for the purpose of producing a cast structure formed of fine equiaxed grains. If its content is less than 0.01 atomic percent, its addition will produce no effect. On the other hand, if its content is greater than 0.05 atomic percent, the alloy will show a reduction in room-temperature ductility. Accordingly, the content of Y should be in the range of 0.01 to 0.05 atomic percent and preferably 0.02 to 0.04 atomic percent.

As has been specifically described above, the present invention makes it possible to improve the material characteristics of a TiAl-base alloy with consideration for cast rotating components which have been ignored in the prior art. Consequently, the TiAl-base alloy can be practically used for the manufacture of the turbine wheels of small-sized superchargers for passenger cars and trucks, and the turbine blades of large-sized superchargers for ships, jet engines and industrial gas turbines, and can thereby contribute to an improvement in the performance or efficiency of these products.

DETAILED DESCRIPTION OF PREFERRED EMBODIMENTS

Figure 1:
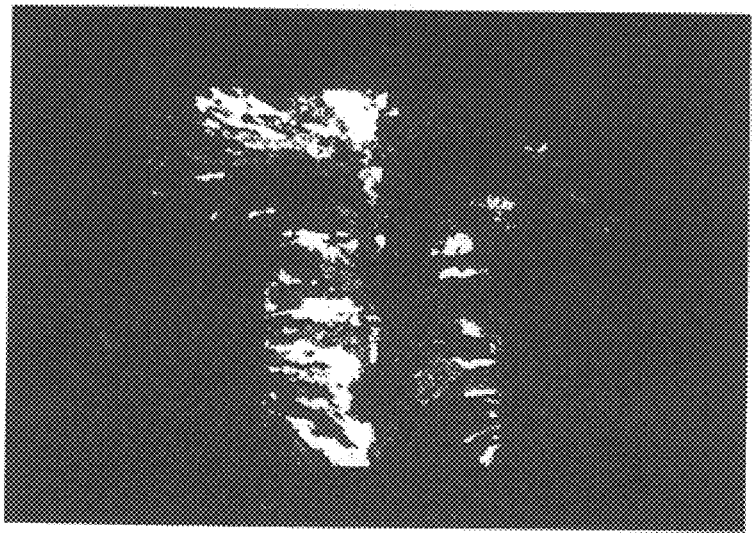
FIG. 1 is a photograph showing, on a full scale, the macrostructure of a section of a precision cast article made of an alloy which departs from the scope of the present invention in that the content of only Y is lower than the range defined by the present invention.

The present invention is more specifically explained with reference to the following examples. Using Ti, Al, Nb, Cr, Si, Ni and Y as raw materials, ingots having the respective compositions shown in Table 1 and measuring 100 mm (diameter)×150 mm (length) were made by high-frequency skull melting. Tension test specimens and creep test specimens having a diameter of 5 mm and a gage length of 22 mm in the parallel part were prepared from the as-cast ingots by machining. Moreover, oxidation test specimens measuring 20 mm×20 mm×2 mm (thickness) and internal friction test specimens measuring 90 mm×10 mm×2 mm (thickness) were also prepared.

Room-temperature ductility was evaluated on the basis of elongations measured in room-temperature tension tests. In these tension tests, the initial strain rate was $3.8\times10^{-4}$/s. High-temperature strength was evaluated on the basis of rupture times measured in creep rupture tests at 800° C. The load stress was 20 kgf/mm$^2$. Oxidation resistance was evaluated on the basis of weight gains on oxidation which were measured after specimens were held at 800° C. for 500 hours. Internal friction was measured at room temperature according to a transverse vibration method.

The evaluation of a cast structure was carried out by precision casting an article having the same shape as an actual product and examining the structure of a section thereof, because the shape of a cast article exerts a great influence on the structure formed. The casting method employed was lost wax precision casting. The article so made had the shape of the turbine wheel of a small-sized supercharger for use in Diesel engines for passenger cars.

The test results are listed in Table 1. The data shown in this table indicates the results of evaluation obtained by using ingots made by high-frequency skull melting and measuring 100 mm (diameter)×150 mm (length).

Example 1 shows the results obtained with an alloy which departs from the scope of the present invention in that the content of only Al is lower than the range defined by the present invention. Its creep strength, internal friction and weight gain on oxidation were satisfactory, but its room-temperature elongation had an unduly low value of 0.5%. Examples 2–4 relate to alloys in accordance with the present invention. All characteristics of them were satisfactory, as evidenced by a room-temperature elongation of 1.1% or greater, a creep rupture time of 660 hours or more, an internal friction ($Q^{-1}$) of $1.7\times10^{-3}$ or greater, and a weight gain on oxidation of 2.3 mg/cm$^2$ or less. Example 5 shows the results obtained with an alloy which departs from the scope of the present invention in that the content of Al is higher than the range defined by the present invention. Its room-temperature elongation, internal friction and weight gain on oxidation were satisfactory, but its creep rupture time had an unduly low value of 468 hours.

Example 6 shows the results obtained with an alloy which departs from the scope of the present invention in that the content of Nb is lower than the range defined by the present invention. Its room-temperature elongation and internal friction were satisfactory, but its creep strength was somewhat lower, and its weight gain on oxidation had an unduly high value of 6.2 mg/cm$^2$. Examples 7–9 relate to alloys in accordance with the present invention. All characteristics of them were satisfactory, as evidenced by a room-temperature elongation of 1.1% or greater, a creep rupture time of 660 hours or more, an internal friction ($Q^{-1}$) of $1.7\times10^{-3}$ or greater, and a weight gain on oxidation of 3.5 mg/cm$^2$ or less. Example 10 shows the results obtained with an alloy which departs from the scope of the present invention in that the content of only Nb is higher than the range defined by the present invention. Its creep strength, internal friction and weight gain on oxidation were substantially the same as those of the alloys of the present invention, but its room-temperature elongation had an unduly low value of 0.9%.

Example 11 shows the results obtained with an alloy which departs from the scope of the present invention in that the content of only Cr is lower than the range defined by the present invention. Its creep strength, internal friction and weight gain on oxidation were satisfactory, but its room-temperature elongation had an unduly low value of 0.6%. Examples 12 and 13 relate to alloys in accordance with the present invention. All characteristics of them were satisfactory, as evidenced by a room-temperature elongation of 1.2% or greater, a creep rupture time of 680 hours or more, an internal friction ($Q^{-1}$) of $1.8\times10^{-3}$ or greater, and a weight gain on oxidation of 2.3 mg/cm$^2$ or less. Example 14 shows the results obtained with an alloy which departs from the scope of the present invention in that the content of only Cr is higher than the range defined by the present invention. Its room-temperature elongation, internal friction and weight gain on oxidation were satisfactory, but its creep rupture time had an unduly low value of 503 hours.

Example 15 shows the results obtained with an alloy which departs from the scope of the present invention in that the content of only Si is lower than the range defined by the present invention. Its room-temperature elongation, internal friction and weight gain on oxidation were satisfactory, but its creep rupture time had an unduly low value of 478 hours. Examples 16 and 17 relate to alloys in accordance with the present invention. All characteristics of them were satisfactory, as evidenced by a room-temperature elongation of 1.0% or greater, a creep rupture time of 630 hours or more, an internal friction ($Q^{-1}$) of $1.7\times10^{-3}$ or greater, and a weight gain on oxidation of 2.1 mg/cm$^2$ or less. Example 18 shows the results obtained with an alloy which departs from the scope of the present invention in that the content of Si is higher than the range defined by the present invention. Its creep strength, internal friction and weight gain on oxidation were satisfactory, but its room-temperature elongation had an unduly low value of 0.6%.

Example 19 shows the results obtained with an alloy which departs from the scope of the present invention in that the content of only Ni is lower than the range defined by the present invention. Its room-temperature elongation, creep strength and weight gain on oxidation were satisfactory, but its internal friction ($Q^{-1}$) had an unduly low value of $0.5\times10^{-3}$. Examples 20–22 relate to alloys in accordance with the present invention. All characteristics of them were satisfactory, as evidenced by a room-temperature elongation of 1.1% or greater, a creep rupture time of 710 hours or more, an internal friction ($Q^{-1}$) of $1.5\times10^{-3}$ or greater, and a weight gain on oxidation of 2.5 mg/cm$^2$ or less. Example 23 shows the results obtained with an alloy which departs from the scope of the present invention in that the content of only Ni is higher than the range defined by the present invention. Its creep strength, internal friction and weight gain on oxidation were satisfactory, but its room-temperature elongation had an unduly low value of 0.7%.

Example 24 shows the results obtained with an alloy which departs from the scope of the present invention in that the content of only Y is lower than the range defined by the present invention. With respect to an ingot made by high-frequency skull melting, its room-temperature elongation, creep strength, internal friction and weight gain on oxidation were satisfactory. However, when this alloy was precision cast into the shape of an actual turbine wheel, it can be seen from FIG.1 showing the macrostructure of a section thereof that its cast structure was columnar. This cast structure is undesirable for high-speed rotating bodies because defects and concentrated impurities tend to appear in the central part.

Figure 2:
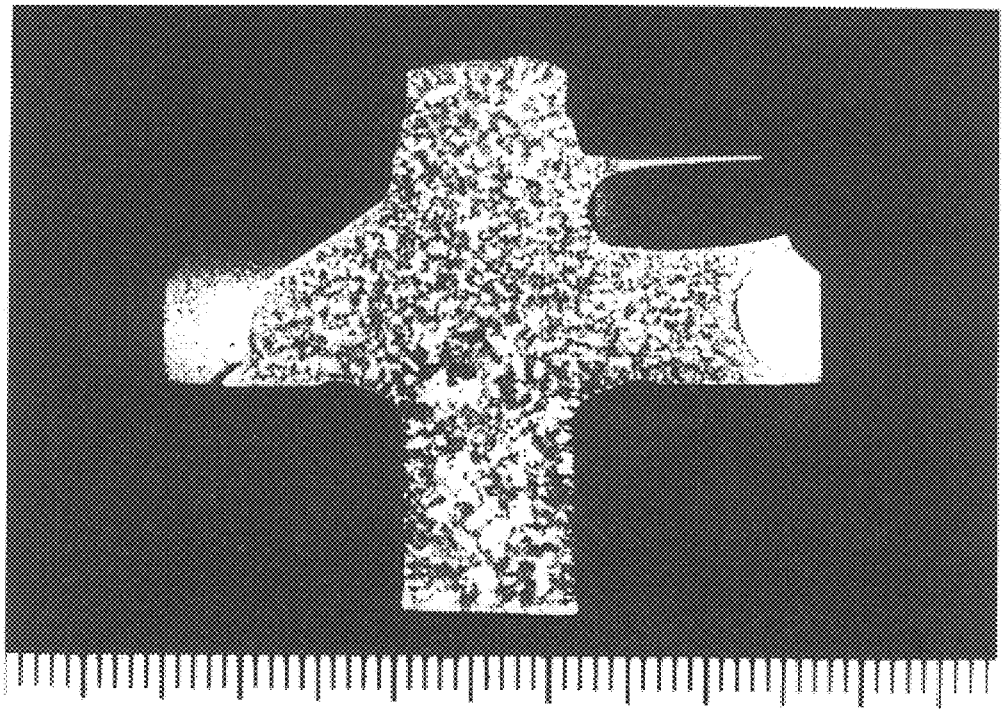
FIG. 2 is a photograph showing, on a full scale, the macrostructure of a section of a precision cast article made of the alloy which is the same as that of FIG. 1, except that content of Y is within the range defined by the present invention.

Examples 25 and 26 relate to alloys in accordance with the present invention. All characteristics of them were satisfactory, as evidenced by a room-temperature elongation of 1.0% or greater, a creep rupture time of 720 hours or more, an internal friction ($Q^{-1}$) of $1.8\times10^{-3}$ or greater, and a weight gain on oxidation of 2.3 mg/cm$^2$ or less. When the alloy of Example 25 was precision cast into the shape of an actual turbine wheel, it can be seen from FIG. 2 showing the macrostructure of a section thereof that its cast structure was formed of fine equiaxed grains. This cast structure is desirable for high-speed rotating bodies.

Example 27 shows the results obtained with an alloy which departs from the scope of the present invention in that the content of Y is higher than the range defined by the present invention. Its creep strength, internal friction and weight gain on oxidation were satisfactory, but its room-temperature elongation had an unduly low value of 0.5%.

TABLE 1

| | Alloy composition (wt. %) | | | | | | Room-temperature elongation | Creep rupture elongation | Internal friction | Weight gain on oxidation |
|---|---|---|---|---|---|---|---|---|---|---|
| Example | Al | Nb | Cr | Si | Ni | Y | (%) | (h) | ($Q^{-1}$) | (mg/cm$^2$) |
| 1 | 44.0 | 7.0 | 1.5 | 0.30 | 1.0 | 0.03 | 0.5 | 780 | $1.6\times10^{-3}$ | 2.2 |
| 2 | 45.0 | 7.0 | 1.5 | 0.30 | 1.0 | 0.03 | 1.1 | 755 | $1.7\times10^{-3}$ | 2.1 |
| 3 | 46.5 | 7.0 | 1.5 | 0.30 | 1.0 | 0.03 | 1.3 | 722 | $1.9\times10^{-3}$ | 2.0 |
| 4 | 47.5 | 7.0 | 1.5 | 0.30 | 1.0 | 0.03 | 1.2 | 663 | $2.0\times10^{-3}$ | 2.3 |
| 5 | 49.0 | 7.0 | 1.5 | 0.30 | 1.0 | 0.03 | 1.4 | 468 | $2.2\times10^{-3}$ | 2.2 |
| 6 | 46.0 | 4.0 | 1.5 | 0.30 | 1.0 | 0.03 | 1.4 | 563 | $2.1\times10^{-3}$ | 6.2 |
| 7 | 46.0 | 5.5 | 1.5 | 0.30 | 1.0 | 0.03 | 1.3 | 665 | $2.0\times10^{-3}$ | 3.5 |
| 8 | 46.0 | 7.0 | 1.5 | 0.30 | 1.0 | 0.03 | 1.2 | 713 | $1.8\times10^{-3}$ | 2.2 |
| 9 | 46.0 | 8.5 | 1.5 | 0.30 | 1.0 | 0.03 | 1.1 | 735 | $1.7\times10^{-3}$ | 1.9 |
| 10 | 46.0 | 10.0 | 1.5 | 0.30 | 1.0 | 0.03 | 0.9 | 769 | $1.8\times10^{-3}$ | 1.8 |
| 11 | 46.0 | 7.0 | 0.7 | 0.30 | 1.0 | 0.03 | 0.6 | 820 | $1.6\times10^{-3}$ | 1.6 |
| 12 | 46.0 | 7.0 | 1.2 | 0.30 | 1.0 | 0.03 | 1.2 | 752 | $1.8\times10^{-3}$ | 1.9 |
| 13 | 46.0 | 7.0 | 1.8 | 0.30 | 1.0 | 0.03 | 1.4 | 685 | $2.2\times10^{-3}$ | 2.3 |
| 14 | 46.0 | 7.0 | 2.2 | 0.30 | 1.0 | 0.03 | 1.4 | 503 | $1.8\times10^{-3}$ | 2.6 |
| 15 | 46.0 | 7.0 | 15 | 0.15 | 1.0 | 0.03 | 1.4 | 478 | $2.3\times10^{-3}$ | 2.3 |
| 16 | 46.0 | 7.0 | 1.5 | 0.22 | 1.0 | 0.03 | 1.2 | 635 | $2.2\times10^{-3}$ | 2.1 |
| 17 | 46.0 | 7.0 | 1.5 | 0.45 | 1.1 | 0.03 | 1.0 | 788 | $1.7\times10^{-3}$ | 1.9 |
| 18 | 46.0 | 7.0 | 1.5 | 0.55 | 1.0 | 0.03 | 0.6 | 836 | $1.4\times10^{-3}$ | 1.7 |
| 19 | 46.0 | 7.0 | 1.5 | 0.30 | 0.2 | 0.03 | 1.3 | 678 | $0.5\times10^{-3}$ | 1.9 |
| 20 | 46.0 | 7.0 | 1.5 | 0.30 | 0.4 | 0.03 | 1.4 | 714 | $1.5\times10^{-3}$ | 2.1 |
| 21 | 46.0 | 7.0 | 1.5 | 0.30 | 1.2 | 0.03 | 1.3 | 723 | $1.8\times10^{-3}$ | 2.4 |
| 22 | 46.0 | 7.0 | 1.5 | 0.30 | 1.8 | 0.03 | 1.1 | 736 | $2.3\times10^{-3}$ | 2.5 |
| 23 | 46.0 | 7.0 | 1.5 | 0.30 | 2.2 | 0.03 | 0.7 | 758 | $2.5\times10^{-3}$ | 2.7 |
| 24 | 46.0 | 7.0 | 1.5 | 0.30 | 1.0 | 0.00 | 1.3 | 756 | $2.1\times10^{-3}$ | 1.9 |
| 25 | 46.0 | 7.0 | 1.5 | 0.30 | 1.0 | 0.01 | 1.2 | 741 | $2.0\times10^{-3}$ | 2.2 |
| 26 | 46.0 | 7.0 | 1.5 | 0.30 | 1.0 | 0.04 | 1.0 | 726 | $1.8\times10^{-3}$ | 2.3 |
| 27 | 46.0 | 7.0 | 1.5 | 0.30 | 1.0 | 0.06 | 0.5 | 706 | $1.6\times10^{-3}$ | 2.5 |

What is claimed is:

1. A TiAl intermetallic compound-based alloy comprising 45 to 48 atomic percent of Al, 7 up to 8 atomic percent of Nb, 1 to 2 atomic percent of Cr, 0.2 to 0.5 atomic percent of Si, 0.3 to 2 atomic percent of Ni, 0.01 to 0.05 atomic percent of Y, and the balance being Ti and incidental impurities, the alloy exhibiting excellent heat resistance, oxidation resistance and resonance resistance and having a cast structure formed of fine equiaxed grains.

2. The TiAl intermetallic compound-based alloy of claim 1 comprising between about 46 and about 47 atomic percent Al.

3. The TiAl intermetallic compound-based alloy of claim 1 comprising between about 1.2 and about 1.6 atomic percent Cr.

4. The TiAl intermetallic compound-based alloy of claim 1 comprising between about 0.3 and about 0.4 atomic percent Si.

5. The TiAl intermetallic compound-based alloy of claim 1 comprising between about 0.5 and about 1.2 atomic percent Ni.

6. The TiAl intermetallic compound-based alloy of claim 1 comprising between about 0.2 and about 0.4 atomic percent Y.

7. A TiAl intermetallic compound-based alloy comprising between about 46 and about 47 atomic percent Al, 7 up to 8 atomic percent Nb, between about 1.2 and about 1.6 atomic percent Cr, between about 0.3 and about 0.4 atomic percent Si, between about 0.5 and about 1.2 atomic percent Ni, between about 0.2 and about 0.4 atomic percent Y, the balance being Ti and incidental impurities, the alloy having excellent heat resistance, oxidation resistance, and resonance resistance, and having a cast structure formed of fine equiaxed grains.

8. A cast rotating component, said component being formed of a TiAl intermetallic compound-based alloy comprising 45 to 48 atomic percent of Al, 7 up to 8 atomic percent of Nb, 1 to 2 atomic percent of Cr, 0.2 to 0.5 atomic percent of Si, 0.3 to 2 atomic percent of Ni, 0.01 to 0.05 atomic percent of Y, and the balance being Ti and incidental impurities, the alloy exhibiting excellent heat resistance, oxidation resistance and resonance resistance and having a cast structure formed of fine equiaxed grains.

9. The component of claim 8, wherein said component comprises a turbine wheel.

10. The component of claim 9 wherein said turbine wheel is a turbine wheel of a supercharger adapted for use in a passenger car or truck.

11. The component of claim 9 wherein said component comprises a turbine blade.

12. The component of claim 11 wherein said turbine blade is a turbine blade of a supercharger adapted for use in a ship, jet engine, or industrial gas turbine.

13. The cast component of claim 8 wherein said alloy comprises between about 46 and about 47 atomic percent Al, 7 up to 8 atomic percent Nb, between about 1.2 and about 1.6 atomic percent Cr, between about 0.3 and about 0.4 atomic percent Si, between about 0.5 and about 1.2 atomic percent Ni, between about 0.2 and about 0.4 atomic percent Y, the balance being Ti and incidental impurities.

14. The component of claim 13, wherein said component comprises a turbine wheel.

15. The component of claim 13 wherein said turbine wheel is a turbine wheel of a supercharger adapted for use in a passenger car or truck.

16. The component of claim 13 wherein said component comprises a turbine blade.

17. The component of claim 13 wherein said turbine blade is a turbine blade of a supercharger adapted for use in a ship, jet engine, or industrial gas turbine.

* * * * *